United States Patent [19]

Polimine

[11] 4,129,354

[45] Dec. 12, 1978

[54] BUS BAR CLAMP

[75] Inventor: Robert F. Polimine, Lynbrook, N.Y.

[73] Assignee: General Signal Corporation, Rochester, N.Y.

[21] Appl. No.: 820,653

[22] Filed: Aug. 1, 1977

[51] Int. Cl.[2] ..... H01R 7/08; H01R 7/18

[52] U.S. Cl. ..... 339/265 F; 24/263 A; 174/171; 403/373

[58] Field of Search ..... 174/68 B, 70 B, 71 B, 174/72 B, 88 B, 129 B, 133 B, 171; 24/263 A; 339/244 R, 249 R, 249 A, 263 L, 265 R, 265 F; 403/373, 376, 383, 393, 396

[56] References Cited

U.S. PATENT DOCUMENTS

| | | | |
|---|---|---|---|
| 1,380,550 | 6/1921 | Getts | 174/129 B X |
| 1,831,798 | 11/1931 | Alsaker | 174/129 B X |
| 1,867,130 | 7/1932 | Alsaker | 174/171 X |
| 1,906,915 | 5/1933 | Massey et al. | 174/129 B X |
| 2,896,012 | 7/1959 | Fjellstedt | 174/171 |

OTHER PUBLICATIONS

*Burndy Electrical Connectors–Catalog* 50, second edition, published by Burndy Engineering Co., Inc., New York, N.Y., copyright 1948, pp. 256 and 269.

*Primary Examiner*—Laramie E. Askin

*Attorney, Agent, or Firm*—Milton E. Kleinman; George W. Killian

[57] ABSTRACT

A cast bus bar clamp with perimetric ribs and a connecting web is provided. The design eliminates abrupt changes in cross-sectional area. This, in turn, provides a less abrupt temperature gradient on cooling which, in turn, minimizes nonuniform solidification which, if present, frequently causes the formation of weakening cracks. To improve the distribution of clamping pressure, the clamp is usually given a convex curvature so that when the clamp is tightened there are five pressure points. The design provides an improved strength-to-weight ratio and a more reliable and economical structure.

6 Claims, 6 Drawing Figures

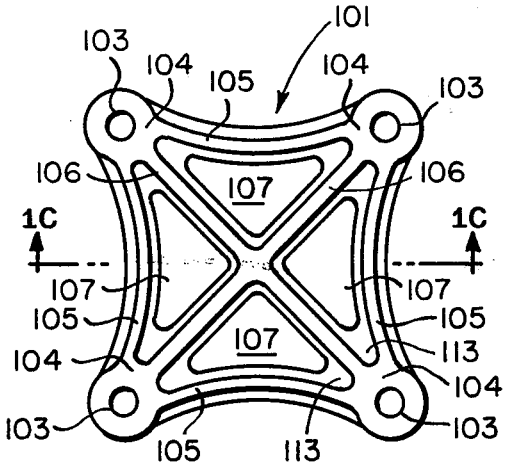
FIG. 1A
(PRIOR ART)
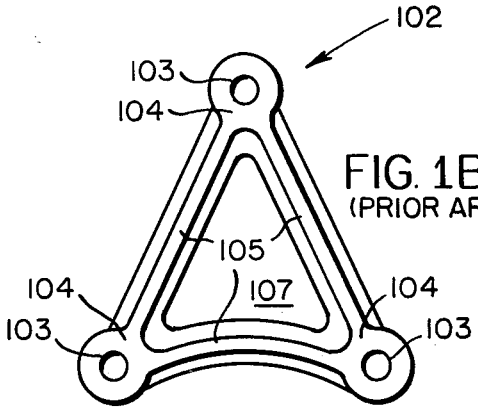
FIG. 1B
(PRIOR ART)
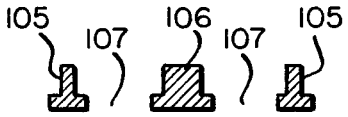
FIG. 1C
(PRIOR ART)
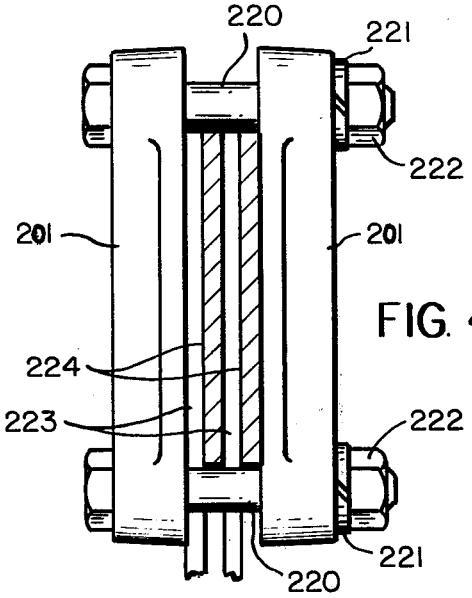
FIG. 4
FIG. 2
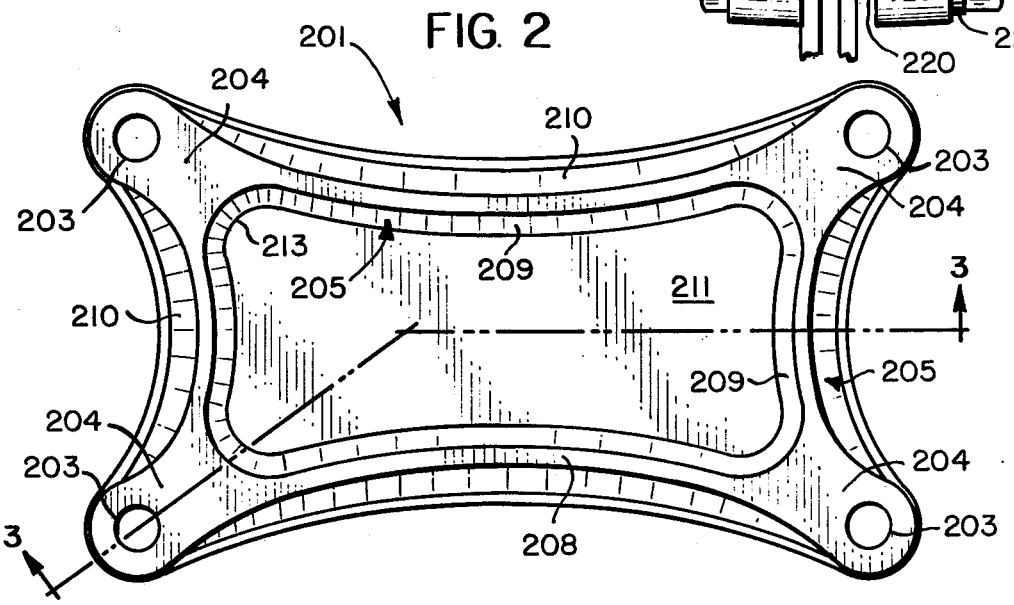
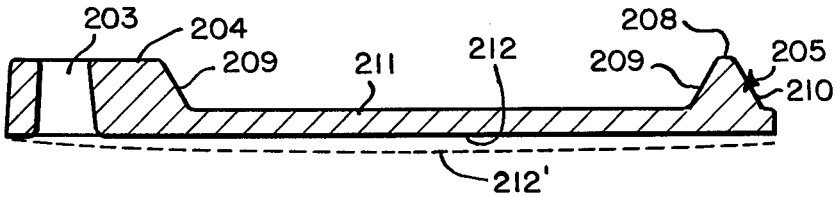
FIG. 3

BUS BAR CLAMP

BACKGROUND OF THE INVENTION

It is standard practice in electrical power generating and distributing systems to use bus bars which comprise a suitable electrical conductor such as copper or aluminum, and which may be up to about 8 inches wide and ⅛ inches, or a little more, thick. In such systems, it is frequently necessary to couple two or more buse bars together to provide the desired current carrying capacity and/or circuit configuration. It has been standard practice to electrically couple two or more bus bars together by means of a pair of opposing clamping plates each of which is formed by a casting process and which comprises rails, or ribs, which are joined together at large lands which extend beyond the limits of the bus bar and include bolt holes. One of these clamping plates may be placed in complementary relationship on each side of the bus bars to be electrically joined. They are coupled together, under tension, by means of fastening means such as bolts passing through the holes in the land areas to provide pressure between the bus bars and provide good electrical contact between the bus bars.

A typical prior art clamping plate provides three rails, or ribs, extending from each of the lands with the bolt hole and extending to some other land area. In a rectangular configuration, diagonal rails are also used. Clamping plates of this type have been used in the industry for an extended period of time and have served admirably under ideal conditions. However, it is not unusual to experience casting difficulties due to nonuniform solidification. That is, after the metal is poured into the mold for making the clamping plate, the relatively thin portions of the rails commence to cool and solidify earlier than the more massive land areas with the bolt hole. Since shrinkage accompanies solidification, the nonuniform solidification frequently results in minute cracks within the structure which weakens it and cause fracture thereof when the plate is applied to bus bars and the coupling bolts tightened. The cracks usually form at junctions with abrupt changes in cross-sectional areas. A fractured clamping plate can not provide adequate pressure and must be removed and replaced. The replacement problems have been reduced by means of a very careful inspection of clamping plates prior to approval for use and/or by carefully controlled temperatures and/or use of chills during solidification. This has resulted in a high rejection rate and increased manufacturing costs.

SUMMARY OF THE INVENTION

The present invention overcomes the enumerated difficulties of the prior art clamping plates by providing a design which has a considerably reduced tendency to develop cracks resulting from shrinkage and nonuniform solidification. Such cracks are sometimes called shrinkage cracks in the casting trade, and are known to be caused by either external loads or internal stresses, or strains acting on a casting during solidification and subsequent contraction at temperatures near the solidus. The present design provides land areas for accommodating fastening or coupling means such as bolts. The land areas are joined by perimetric ribs which are normally bowed inward and which are connected their entire length by a web. Thus the new clamping plate is characterized in that it does not include any perforations other than those required for the bolt holes. Cross ribs are not used. By reducing the number of ribs extending from each land area, and by providing the connecting web, a design is provided which does not have abrupt changes in cross-sectional area and, therefore, has a more uniform temperature gradient during cooling and, therefore, is less subject to nonuniform solidification and weakening cracks which result therefrom. Accordingly, the present design may be manufactured with a greatly reduced rejection rate and without requiring such precise temperature controls during cooling and solidification, or the use of chills or cracking strips which add to cost. Obviously, this results in a clamping plate which is more economical to manufacture and which is less likely to fail in use.

The elimination of the cross ribs and the inclusion of the joining web results in little, if any, difference in the amount of metal used for a given size clamping plate, and provides a high strength-to-weight ratio. The perimetrically ribbed and webbed clamping plates are much more economical to manufacture because of the greatly reduced rejection rate.

It is an object of this invention to provide a new and improved bus bar clamping plate.

It is a more specific object of this invention to provide a new and improved bus bar clamping plate which is less subject to defects on manufacture.

It is a more specific object of this invention to provide a cast bus bar clamping plate with a greatly reduced tendency to form cracks due to nonuniform solidification.

It is another object of this invention to provide a clamping plate of the character described and including perimetrical ribs which are conjoined at junction points and which are joined by a web.

It is another object of this invention to provide a bus bar clamping plate with a convexoconcave web to improve the contact pressure between the clamped bus bars after application of the clamping plate.

BRIEF DESCRIPTION OF THE DRAWING

Elements shown in more than one figure are given the same identification number in all figures.

FIGS. 1A, 1B, and 1C illustrate prior art structures with FIG. 1C comprising a cross-section of FIG. 1A taken along line 1C—1C.

FIG. 2 illustrates a typical clamping plate in accordance with the present invention.

FIG. 3 comprises a cross-section of the clamping plate of FIG. 2 taken on line 3—3; and FIG. 4 is a side view of a pair of clamping plates clamping bus bars in electrical contact.

DESCRIPTION OF THE PREFERRED EMBODIMENT

The advantages of the present invention will become most apparent after a brief consideration of the prior art structures and, therefore, attention is directed to typical prior art structures as indicated in FIGS. 1A, 1B, and 1C. As may be seen in FIGS. 1A and 1B, a typical prior art clamping plate 101 or 102 comprises a structure which may be generally square, rectangular, or even triangular. The clamping plate 101 of FIG. 1A includes a plurality of bolt holes 103 located in land areas or apexes 104 and which are joined by rails 105. As may be more clearly seen in FIG. 1C, the rails 105 have an upside down T-shape cross-section. The clamping plate 101 also includes cross rails 106. Between the rails is an open space 107, as may be seen in each of the FIGS. 1A, 1B, and 1C.

There are two obvious physical differences between the clamping plate of FIGS. 1A, 1B, and 1C and that of the invention. These are, first, the clamping plate of the invention does not include cross rails 106 and, second, the clamping plate of the invention does not include spaces 107. Other more important, but more subtle, distinctions will be appreciated as the following description proceeds.

Considering now more specifically FIG. 2, there will be seen therein a clamping plate indicated generally as 201 and including a plurality of bolt holes 203 located in land areas or coupling members 204 and which are joined by ribs 205. It will be seen that the ribs 205 are perimetric in that they are formed generally around the entire perimeter of the clamping plate 201. As may be seen more clearly in FIG. 3, the ribs 205 comprise a peak portion 208, an inner sloping side 209 and an outer sloping side 210. As may be most clearly seen in FIG. 3, the clamping plate 201 also includes a web 211 which forms a base of the clamping plate 201 and joins together, or connects, the inner sloping side 209 of the ribs 205.

The clamping plate 201 may be fabricated by a casting process, such as sand casting, and, therefore, it is necessary to provide draft clearances in order to permit removal of the patterns from the sand mold. The inner and outer sloping sides 209 and 210 provide appropriate drafts for the ribs 205. In addition, it will be seen that an appropriate draft clearance is provided for the bolt holes 203 and, as may be seen most clearly in FIG. 3, appropriate edges have been rounded and fillets provided. Although not shown in these drawings, it should be understood that conventional gates and risers are used in the manner well known in the casting trade.

By providing relatively large draft angles on the ribs and by including the web 211, it has been possible to provide a clamping plate design wherein changes in cross-sectional area are more gradual. This provides a structure wherein there is a minimum temperature gradient on cooling and, therefore, a reduced tendency for nonuniform solidification and the concomitant formation of shrinkage cracks.

Clamping plates of the type shown in either FIGS. 1A or 2 may be made to accommodate bus bars up to about 8 inches wide and, therefore, an approximate maximum size of the clamping plate is about 8 inches × 8 inches as measured from the inside limits of one of the holes 203 to the equivalent point of an adjacent hole. Clamps of the prior art type as shown in FIG. 1A and clamps of FIG. 2, when designed for accommodating a given size bus bar, will have equivalent weights with the clamps of FIG. 2 having a higher weight-to-strength ratio.

The metal of which the clamping plate 201 is fabricated may be any of the variety of metals used in the prior art including, but not limited to, various ferrous combinations and bronze, or other special alloys which may or may not be plated to enhance the appearance or resist ambient atmospheric corrosive conditions. A typical ferrous metal clamping plate may be made of standard malleable iron.

The clamping plate 201 may be used to clamp two or more bus bars to make a joint. Typical bus bars may range from approximately ⅛ to ½ of an inch in thickness, and from 2 to 8, and occasionally several more, are clamped together by a pair of clamping plates. FIG. 4 illustrates two clamping plates 201 coupled together by bolts 220. Lock washers 221 may be used with the bolts 220 to prevent loosening of the nuts 222. FIG. 4 illustrates the clamping of four bus bars which are arranged in sandwich fashion with bus bars 223 extending at right angles to the bus bars 224.

It is good practice to clean the copper surfaces of the bus bars 223 and 224 in the area of electrical contact with each other. In addition, in order to provide good contact pressure over as much of the surface of the bus bars 223 and 224 as possible, the clamping plate 201 is formed with a nonplanar surface as illustrated in FIG. 3, wherein the bottom surface 212 is bowed from its planar position to that illustrated by the dotted line 212'. Typically, this bow is not cast into the clamping plate 201, but is formed subsequent to the casting by supporting the clamping plate 201 at the four positions of the bolt holes 203 and applying a pressure to produce a controlled permanent convex curvature. Although this might include a curvature comprising a straight line when intersected by at least some planes, it is comtemplated that the curvature would be convex when intersected by any plane. Thus, when the clamping plate 201 is coupled to the bus bars 223 and 224 and the bolts 220 are tightened by turning the nut 222, pressure will be applied at the center of the clamping plate and as the tightening process continues, the bow will be reduced and pressure will be applied from the center towards the edges of the clamping plate to provide five-point pressure and good electrical contact between the bus bars 223 and 224. The actual pressure applied may vary from approximately 2,000 to 5,000 pounds per square inch. Depending on the size of the clamping plate 201, the bolts 220 may have diameters from approximately ⅜ to ⅝ of an inch and be able to withstand a tension of approximately 40,000 pounds per square inch. If the bolts 220 are over tightened, they should break under tensile stress prior to breaking the clamping plate 201. Maximum pressure points are near the bolt locations and at the complementary convex peaks of the web 211 which has initial contact with the bus bar during assembly.

As was conventional with prior art clamping plates, the ribs 205 are bowed inward in order to assure that a maximum portion of the rib 205 will be over the bus bar contact area applying pressure to assure good electrical conductivity between the clamped bus bars.

The prior art clamping plate as shown in FIG. 1 provided three rails extending from each land area 104, whereas the new design provides two ribs 205 extending from each land area 204. The new design permits the use of a larger radius of curvature 213 between adjacent ribs 205 as compared with the radius of curvature 113 used in the prior art. The increased radius of curvature 213 and the more gradual change in cross-sectional area provided thereby produces a structure which is less vulnerable to shrinkage and cracking which results in weakened structures.

While there has been shown and described what is considered at the present to be a preferred embodiment of the invention, modifications thereto will readily occur to those skilled in the related arts. For example, the ribs might not have a uniform cross-section or height throughout their entire length and/or the web may not be of uniform thickness. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, but it is intended to cover in the appended claims all such modifications as fall within the true spirit and scope of the invention.

What is claimed is:

1. A bus bar clamping structure for clamping together a plurality of bus bars, having planar and parallel surfaces, to provide electrical continuity be tween said bus bars and comprising in combination:

(a) first and second complementary plates each having a generally rectangular configuration, perimetric ribs and fabricated of material subject to deformation in response to stress;

(b) each plate having a web joining said perimetric ribs thereof and extending over the entire area enclosed by said perimetric ribs;

(c) one surface of said web of each plate forming a common surface with one surface of said ribs thereof;

(d) said common surface having a curvature such that if said common surface of one of said plates is placed on a planar horizontal surface, the plate contacts the horizontal surface at a single point with said single point being at the approximate geometric center of said plate;

(e) coupling means for coupling said first and second plates in complementary relationship on opposite sides of a plurality of bus bars, and with said common surfaces facing each other, and (f) said coupling means including tensioning means for increasing the stress between said common surfaces whereby said common surface are deformed and pressure is applied to said common surfaces starting from said single point and radiating outward towards the limits of said common surfaces.

2. The combination as set forth in claim 1, wherein said perimetric ribs are conjoined at junction points to form a plurality of land areas for accommodating said coupling means.

3. The combination as set forth in claim 2, wherein said land areas include holes for accommodating bolts.

4. The combination as set forth in claim 3, wherein each of said perimetric ribs is bowed towards the center of the web.

5. The combination as set forth in claim 1, wherein said web is of approximately uniform thickness.

6. The combination as set forth in claim 5, wherein the other surface of said web is joined to said ribs with a fillet whereby there is a gradual change in thickness from said web to said rib.

* * * * *